US010683828B2

(12) United States Patent
Howard et al.

(10) Patent No.: US 10,683,828 B2
(45) Date of Patent: Jun. 16, 2020

(54) MOUNTING BRACKET

(71) Applicant: CUMMINS INC., Columbus, IN (US)

(72) Inventors: Kenneth L. Howard, Indianapolis, IN (US); Mahesh Kumar Koyyada, Columbus, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 16/348,812

(22) PCT Filed: Nov. 28, 2017

(86) PCT No.: PCT/US2017/063368

§ 371 (c)(1),
(2) Date: May 9, 2019

(87) PCT Pub. No.: WO2018/102279

PCT Pub. Date: Jun. 7, 2018

(65) Prior Publication Data

US 2019/0345893 A1 Nov. 14, 2019

Related U.S. Application Data

(60) Provisional application No. 62/429,378, filed on Dec. 2, 2016.

(51) Int. Cl.
*F02F 7/00* (2006.01)
*F02B 67/04* (2006.01)

(52) U.S. Cl.
CPC ..... *F02F 7/0068* (2013.01); *F02B 67/04* (2013.01); *F02F 2007/0041* (2013.01)

(58) Field of Classification Search
CPC .... F02F 7/0068; F02F 2007/0041; F02F 7/00; F02B 67/04
See application file for complete search history.

(56) References Cited

U.S. PATENT DOCUMENTS 3,022,778 A * 2/1962 Stemen ..... H02K 5/00 123/195 E
3,778,957 A 12/1973 Appleberry
(Continued)

FOREIGN PATENT DOCUMENTS

DE 42 28 625 3/1994
FR 2902706 A3 * 12/2007 ..... B60K 17/24
(Continued)

OTHER PUBLICATIONS

International Search Report from corresponding PCT Application No. PCT/US2017/063368, dated Mar. 8, 2018, pp. 1-2.
(Continued)

*Primary Examiner* — Hung Q Nguyen
(74) *Attorney, Agent, or Firm* — Foley & Lardner LLP

(57) ABSTRACT

A bracket includes a bracket body, a threaded insert, and a fastener. The bracket body defines a first opening positioned to align with a second opening in a cylinder head. The threaded insert is positioned in the first opening. The threaded insert includes an exterior surface threadably engaged with the first opening, an inner surface defining an aperture, and an end face. Rotation of the threaded insert in the first opening facilitates selective repositioning of the threaded insert in the first opening. The fastener is configured to be received in the aperture of the threaded insert. The aperture is configured to receive a tool for selective rotation of the threaded insert.

20 Claims, 8 Drawing Sheets

(56) References Cited

U.S. PATENT DOCUMENTS

| | | | | |
|---|---|---|---|---|
| 4,662,807 | A | 5/1987 | Lien et al. | |
| 6,308,476 | B1 | 10/2001 | Nakamoto et al. | |
| 6,324,744 | B1 * | 12/2001 | Banks | F02F 7/0046 123/195 A |
| 6,357,953 | B1 | 3/2002 | Ballantyne | |
| 6,776,566 | B2 | 8/2004 | Kobusch et al. | |
| 7,119,466 | B2 * | 10/2006 | Kashihara | H02K 5/00 310/91 |
| 7,588,386 | B2 | 9/2009 | Kielczewski et al. | |
| 2009/0025320 | A1 | 1/2009 | Wagner et al. | |
| 2009/0159038 | A1 | 6/2009 | Koyama et al. | |
| 2015/0251536 | A1 | 9/2015 | Sullivan et al. | |

FOREIGN PATENT DOCUMENTS

| | | | | |
|---|---|---|---|---|
| IN | 01122MUM2013 | | | 5/2015 |
| IN | 01161MUM2013 | | | 5/2015 |
| JP | 04314924 | A | * | 11/1992 |
| JP | 2003-049706 | A | | 2/2003 |

OTHER PUBLICATIONS

Written Opinion Report from corresponding PCT Application No. PCT/US2017/063368, dated Mar. 8, 2018, pp. 1-5.

* cited by examiner

MOUNTING BRACKET

CROSS-REFERENCE TO RELATED APPLICATIONS

The present application is the U.S. national phase of PCT Application No. PCT/US2017/063368, filed Nov. 28, 2017, which claims priority to U.S. Provisional Patent Application No. 62/429,378, entitled "Mounting Bracket" and filed Dec. 2, 2016 and the contents of which are incorporated herein by reference.

TECHNICAL FIELD

The present disclosure relates to the field of brackets for mounting components, for example for use in mounting components on internal combustion engines or the like.

BACKGROUND

Challenges faced in mounting a bracket (e.g., support, etc.) to two separate components include overcoming a gap between the bracket and at least one of the components that exists because of a tolerance stack-up. This gap can result in increased stresses in fasteners that hold the bracket to the components. Traditionally, this gap exists when a bracket is mounted to two separate components.

Brackets may be used to mount components, such as alternators, to an internal combustion engine. Challenges faced in mounting an alternator to an internal combustion engine, for example, include providing proper support to the alternator and associated components (e.g., tensioners, pulleys, etc.). Traditionally, alternators are mounted only to a cylinder block. However, as alternators have become heavier (e.g., dual alternator applications, etc.), a need exists to mount the alternator to the cylinder block and to a cylinder head separate from the cylinder block. Because the alternator is mounted to two separate components, a gap traditionally exists due to a tolerance stack-up.

SUMMARY

In an embodiment, a bracket includes a bracket body, a threaded insert, and a fastener. The bracket body defines a first opening positioned to align with a second opening in a cylinder head. The threaded insert is positioned in the first opening. The threaded insert includes an exterior surface threadably engaged with the first opening, an inner surface defining an aperture, and an end face. Rotation of the threaded insert in the first opening facilitates selective repositioning of the threaded insert in the first opening. The fastener is configured to be received in the aperture of the threaded insert. The aperture is configured to receive a tool for selective rotation of the threaded insert.

In an embodiment, a bracket includes a bracket body, a threaded insert, and a fastener. The bracket body defines a first opening positioned to align with a second opening in a component. The threaded insert is positioned in the first opening. The threaded insert includes an exterior surface threadably engaged with the first opening, an inner surface defining an aperture, and an end face. Rotation of the threaded insert in the first opening facilitates selective repositioning of the threaded insert in the first opening. The aperture is configured to receive a tool for selective rotation of the threaded insert.

In an embodiment, a system for supporting an alternator on a cylinder head and a cylinder block, the system includes a bracket. The bracket is configured to receive and support at least one alternator. The bracket comprises an extension defining a first opening, a threaded insert in the first opening, and a fastener in the threaded insert. The threaded insert includes an exterior surface threadably engaged with the first opening and an inner surface defining an aperture. The fastener is positioned in the aperture. The first opening in the bracket is defined to align with a second opening in the cylinder head. The aperture defines a tool interface, and rotation of the threaded insert by force exerted in the tool interface causes rotation of the threaded insert in the first opening such that an end face of the threaded insert selectively moves relative to the cylinder head. The bracket is further configured for attachment to the cylinder block.

In another embodiment, a system includes a cylinder block, a cylinder head, a bracket, and a first threaded insert. The cylinder head is coupled to the cylinder block, the cylinder head defining a first opening. The bracket comprises an extension, the extension defining a second opening, the second opening aligned with the first opening. The first threaded insert is received in the second opening, the first threaded insert defining a first aperture, the first aperture receiving a first fastener that extends from the second opening and is threadably engaged with the first opening. The first aperture selectively receives a tool. Rotation of the tool in the first aperture causes rotation of the first threaded insert in the second opening such that a first end face of the first threaded insert is selectively repositioned relative to the cylinder head.

In another embodiment, a system for providing support from a first component and a second component, the system includes a bracket. The bracket includes an extension defining a first opening, a threaded insert in the first opening, and a fastener in the threaded insert. The threaded insert includes an exterior surface threadably engaged with the first opening and an inner surface defining an aperture. The fastener is positioned in the aperture. The first opening in the bracket is defined to align with a second opening in the first component. The fastener threadably engages with the second opening. The aperture defines a tool interface, and rotation of the threaded insert by force exerted in the tool interface causes rotation of the threaded insert in the first opening such that an end face of the threaded insert selectively moves relative to the first component. The bracket is further configured for attachment to the second component such that the bracket is fixed to, and supported by, the second component.

In another embodiment, a bracket includes a bracket body and a threaded insert. The bracket body defines a first opening that is positioned to align with a second opening in a cylinder head. The first opening is configured to threadably engage with a fastener. The bracket body includes a first flange located in the first opening. The first flange defines a first aperture that is configured to receive the fastener and that is configured to interface with a flange of the fastener when the fastener is threaded into the second opening. The threaded insert is configured to be received in the first opening between the cylinder head and the first flange when the bracket is installed. The threaded insert includes an exterior surface, an inner surface, and an end face. The exterior surface is threadably engaged with the first opening. The inner surface defines a second aperture that is configured to receive the fastener. Rotation of the threaded insert in the first opening facilitates selective repositioning of the threaded insert in the first opening. The second aperture is configured to receive a tool for selective rotation of the threaded insert.

BRIEF DESCRIPTION OF THE DRAWINGS

The details of one or more implementations are set forth in the accompanying drawings and the description below. Other features, aspects, and advantages of the disclosure will become apparent from the description, the drawings, and the claims.

Figure 1:
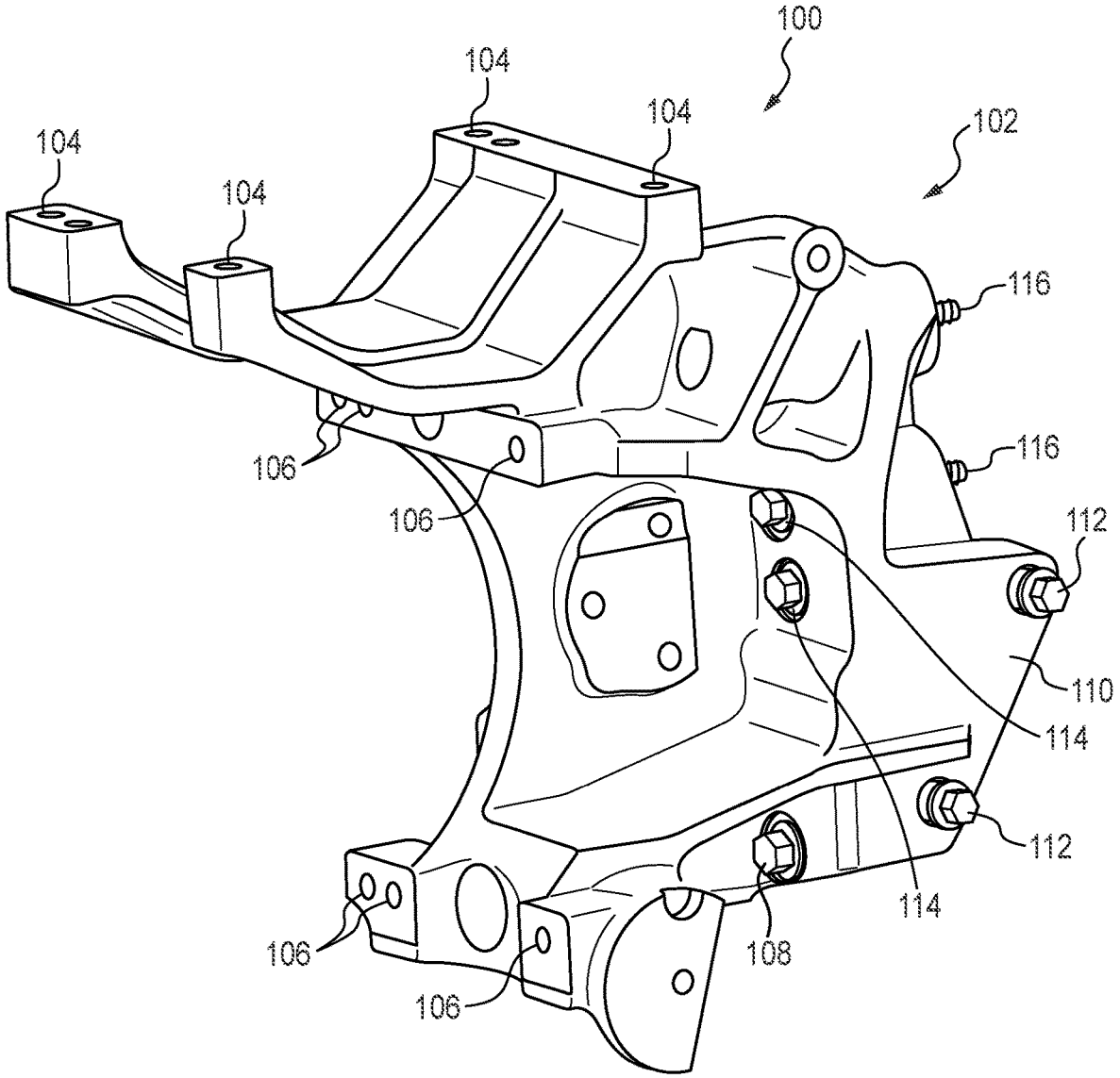
FIG. 1 is a front perspective view of a bracket according to an embodiment.

It will be recognized that the figures are representations for purposes of illustration. The figures are provided for the purpose of illustrating one or more implementations with the explicit understanding that they will not be used to limit the scope or the meaning of the claims.

DETAILED DESCRIPTION

In the following detailed description, reference is made to the accompanying drawings, which form a part thereof. In the drawings, similar symbols typically identify similar components, unless context dictates otherwise. The illustrative embodiments described in the detailed description, drawings, and claims are not meant to be limiting. Other embodiments may be used, and other changes may be made, without departing from the spirit or scope of the subject matter presented here. It will be readily understood that the aspects of the present disclosure, as generally described herein, and illustrated in the figures, can be arranged, substituted, combined, and designed in a wide variety of different configurations, all of which are explicitly contemplated and made part of this disclosure.

In embodiments of the present disclosure, a bracket is provided. According to various embodiments, the bracket is provided for mounting an alternator to an internal combustion engine. However, the bracket may be implemented for supporting various mounted components (i.e., components mounted to the bracket), and for positioning the various mounted components with respect to two separate components. In some implementations, the bracket may be implemented for supporting various mounted components on any combination of a cylinder block, a cylinder head, a gear housing, and an accessory drive. However, it is understood that the bracket may be mounted to other similar components. For example, the bracket may support an alternator and position the alternator with respect to a cylinder head and a cylinder block of an internal combustion engine.

When a component is mounted, one or more gaps may exist between a bracket and components to which the bracket is attached (e.g., gaps between a bracket and a cylinder block or a cylinder head, gaps between a gear housing and a cylinder block, gaps between a gear housing and a cylinder head, gaps between an accessory drive and a cylinder block, etc.). A size and shape of the gap or gaps may vary for different bracket and component combinations (e.g., for different cylinder heads, for different cylinder blocks, for different gear housings, for different accessory drives, etc.). The gap(s) can allow the bracket to move with respect to the components it is attached to. For example, the bracket may move with respect to a cylinder block or a cylinder head. This movement can cause stress and resultant damage to the bracket. In some cases, this movement can cause impact of portions of the bracket against the components it is mounted to, which can also result in damage. The gap(s) cause increased stresses on fasteners that attach the bracket to the components, thus increasing the likelihood that these fasteners will fail.

In embodiments of the present disclosure, to reduce movement of the bracket, threaded inserts and spacers are used to better position and secure the bracket to the components it is mounted to. Further, the threaded inserts are selectively repositionable within corresponding holes or openings (e.g., apertures, etc.) to accommodate various combinations of the bracket and the components it is mounted to.

Figure 2:
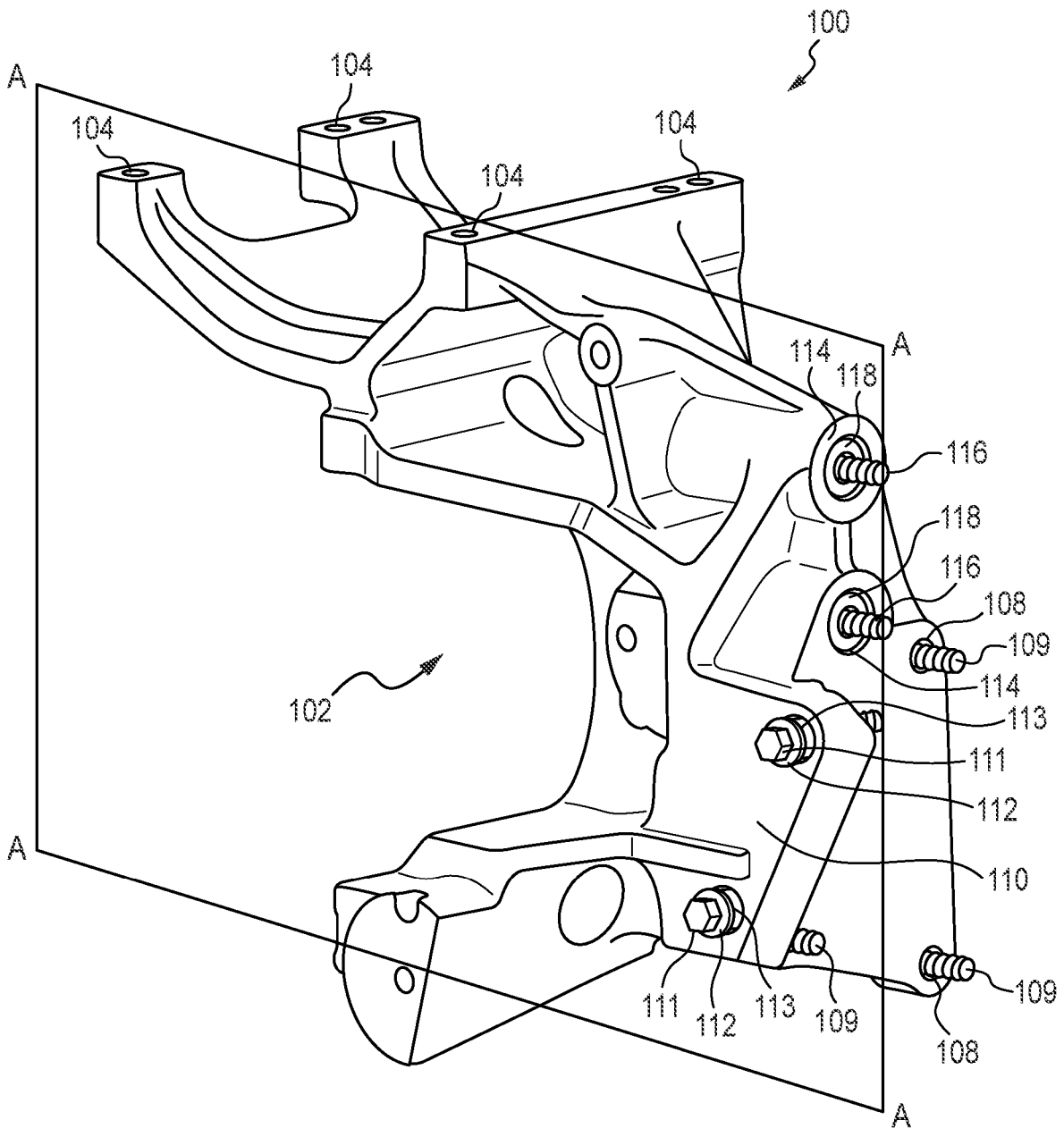
FIG. 2 is a rear perspective view of the bracket shown in FIG. 1.
Figure 3:
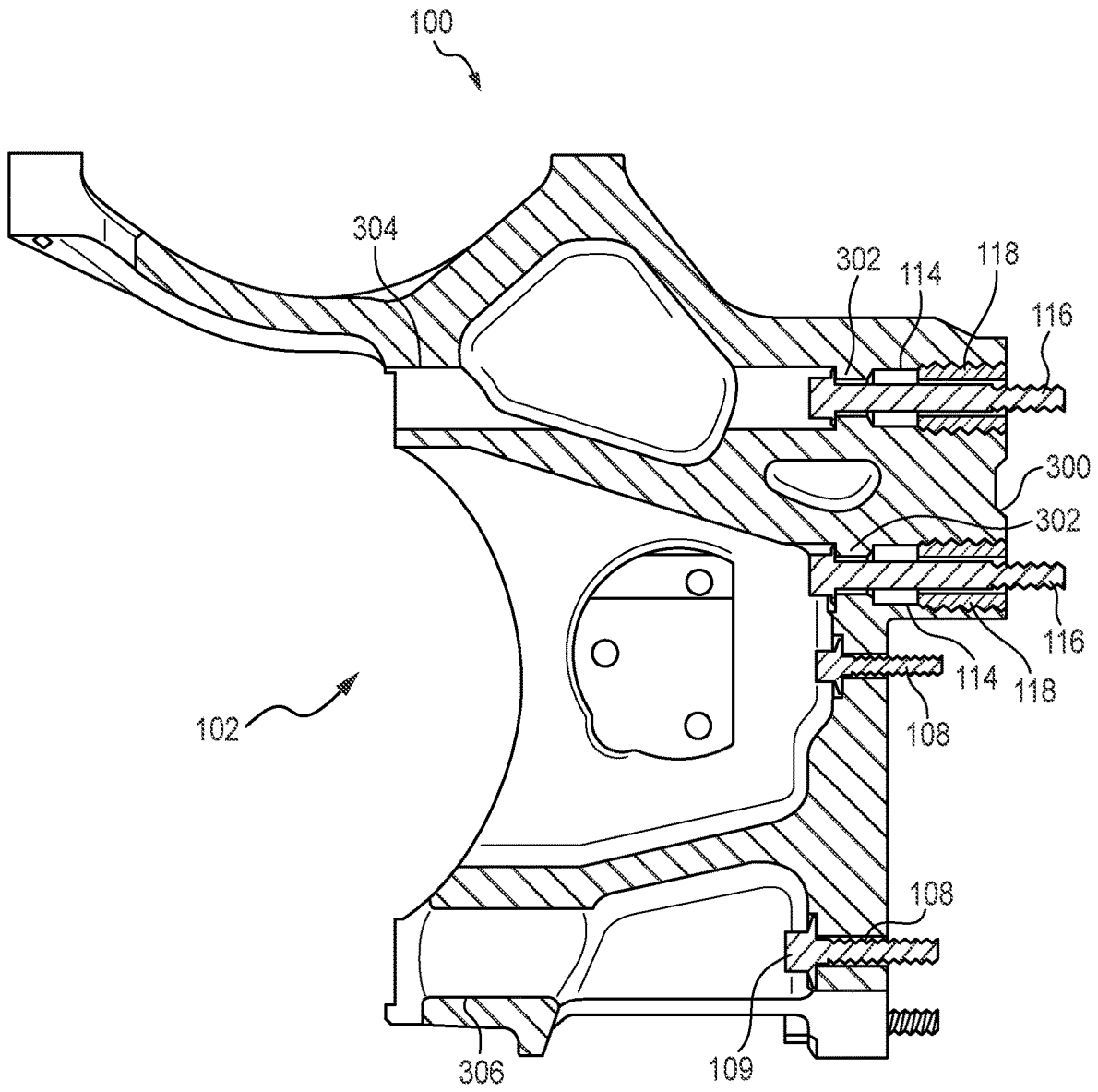
FIG. 3 is a side cross-sectional view of the bracket shown in FIGS. 1 and 2 along plane A-A in FIG. 2.
Figure 5:
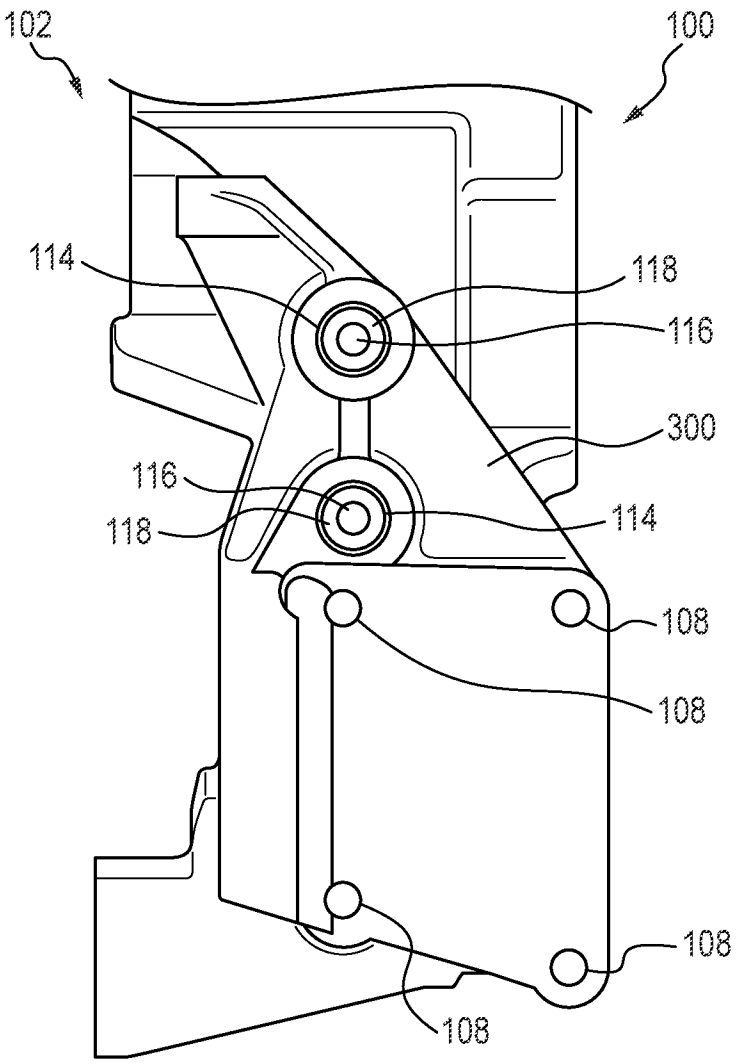
FIG. 5 is a right side view of the bracket shown in FIG. 1.
Figure 4:
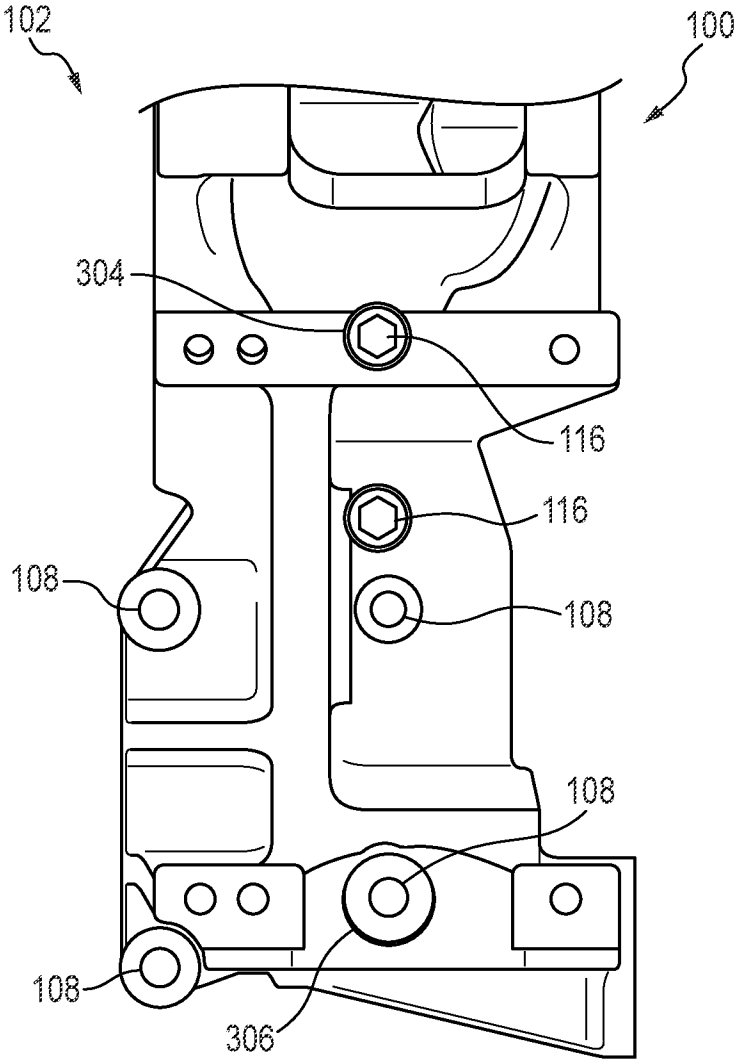
FIG. 4 is a left side view of the bracket shown in FIG. 1.
Figure 6:
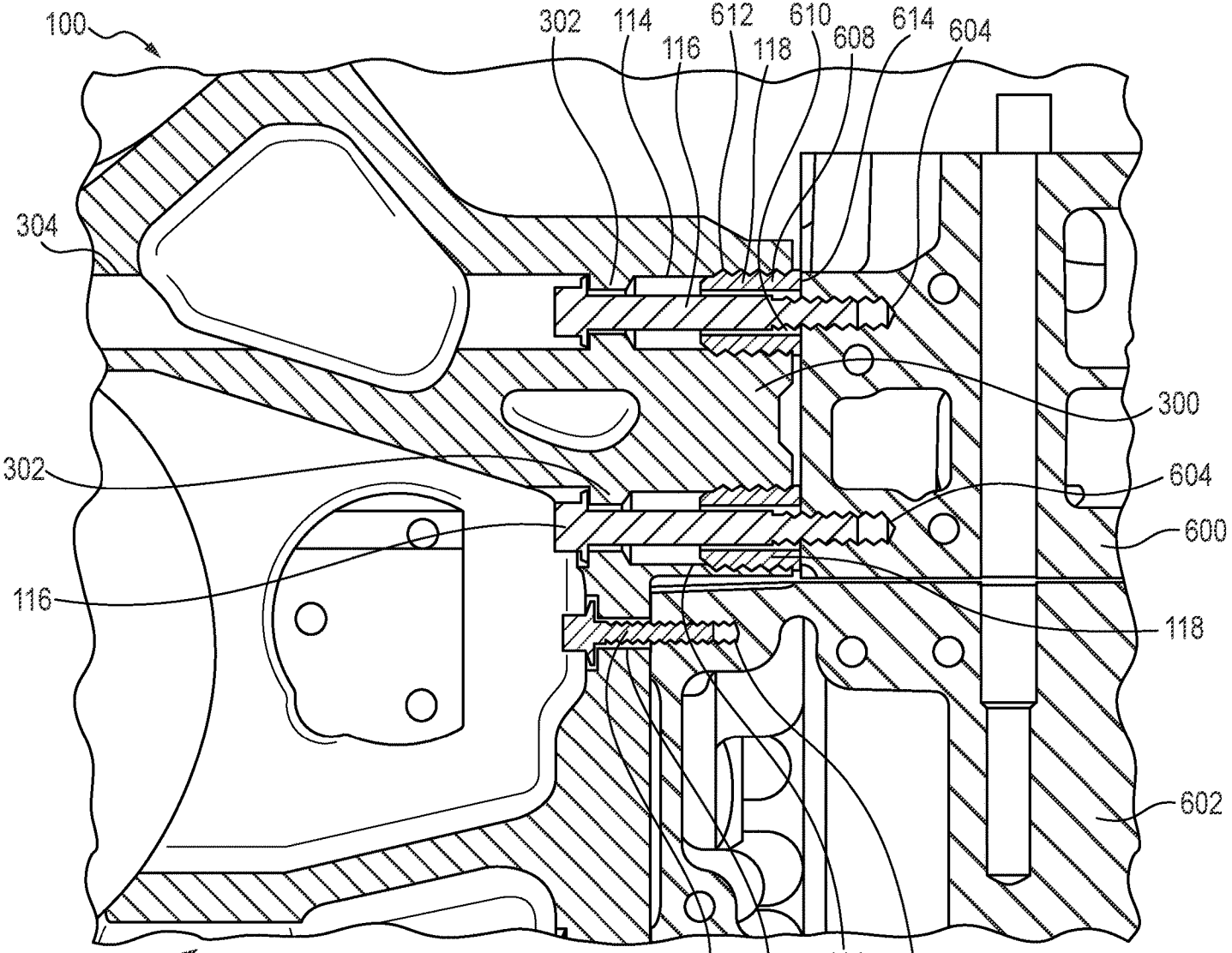
FIG. 6 is a cross-sectional view of the bracket shown in FIG. 1 mounted to a cylinder head and a cylinder block according to an embodiment.
Figure 7:
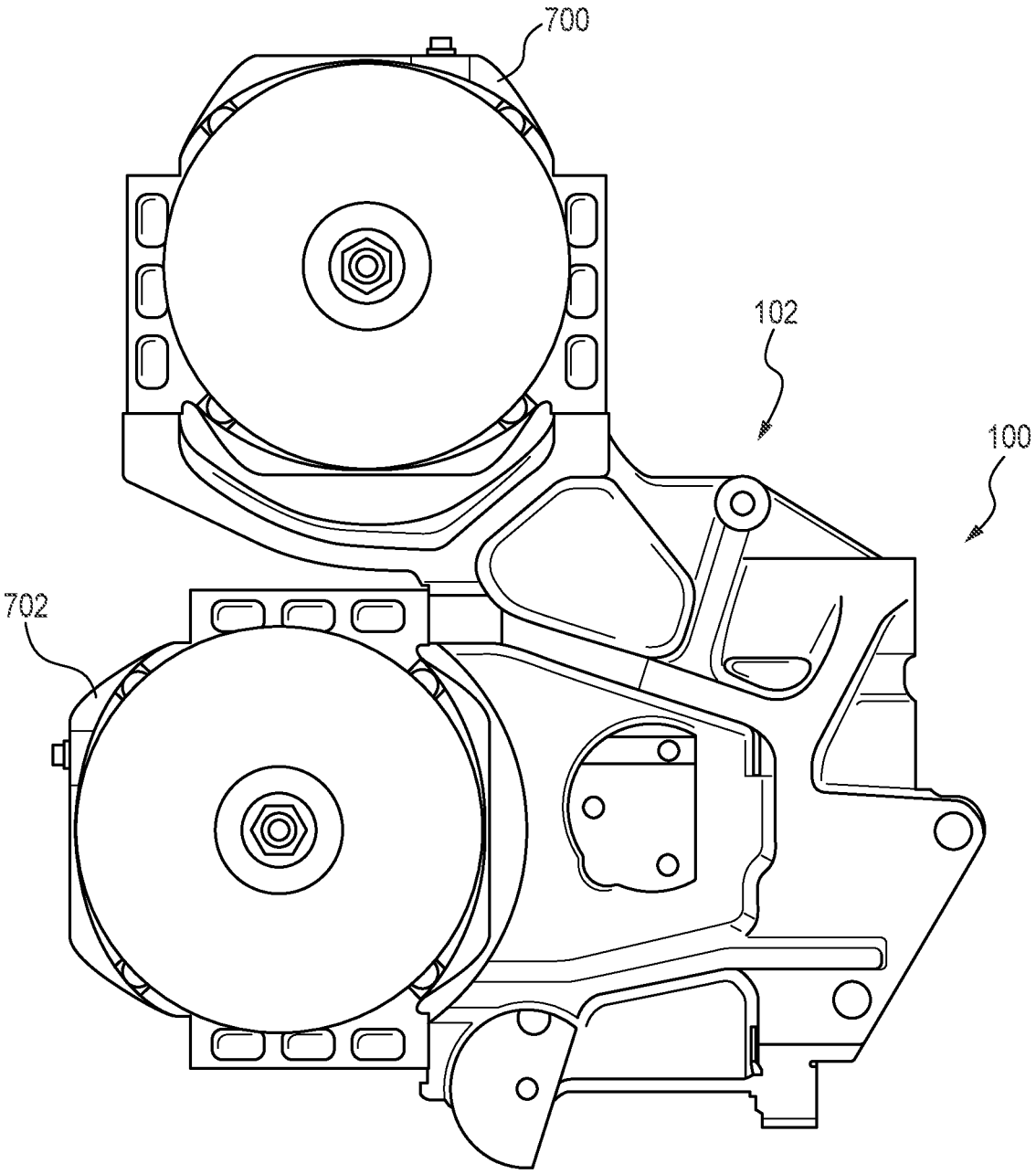
FIG. 7 is a front view of two alternators mounted to the bracket shown in FIG. 1 according to an embodiment.

FIGS. 1-7 illustrate various views (in various perspectives) of examples of a bracket according to embodiments of the present disclosure. FIG. 2 is a rear perspective view of the bracket shown in FIG. 1. FIG. 3 is a side cross-sectional view of the bracket shown in FIGS. 1 and 2 along plane A-A in FIG. 2. FIG. 4 is a left side view of the bracket shown in FIG. 1. FIG. 5 is a right side view of the bracket shown in FIG. 1. FIG. 6 is a cross-sectional view of the bracket shown in FIG. 1 mounted to a cylinder head and a cylinder block according to an embodiment. FIG. 7 is a front view of two alternators mounted to the bracket shown in FIG. 1 according to an embodiment.

The bracket may be implemented in, for example, a diesel engine, a gasoline engine, a natural gas engine, a propane engine, a forced induction engine, a naturally aspirated engine, or any other internal combustion engine. In some embodiments, the bracket is implemented in a vehicular system (e.g., an automobile, a truck, a commercial vehicle, an emergency vehicle, or a construction vehicle); however, the concepts of the present disclosure are not limited to implementation in a vehicular system.

In FIGS. 1-7, the bracket 100 comprises a body 102 (e.g., a boss or frame). The body 102 is structured to be coupled to various components. For example, in various embodiments, the body 102 is structured to be coupled to an internal combustion engine. In other examples, the body 102 is structured to be coupled to a gear housing and/or an accessory drive. In some embodiments, the body 102 is formed via a casting process. In other embodiments, the body 102 is formed via a milling, machining, forging, or other technique. The body 102 may be subjected to various machining and finishing processes such as drilling, honing, and tapping.

The bracket 100 as illustrated is structured to be coupled to two alternators; however, the concepts of the present disclosure are not so limited. Each alternator may interface with a belt to convert mechanical energy into electrical energy. This electrical energy may be provided to various electrical systems. In addition to an alternator, the bracket 100 may also support additional components, such as a primary belt tensioner, a secondary belt tensioner, and a belt pulley.

As shown in FIG. 1, the bracket 100 includes a set of first openings or holes 104 for coupling to a first component and a set of second openings or holes 106 for coupling to a second component. In operation, for example, the bracket 100 suspends the first component coupled to the first holes 104 above the second component coupled to the second holes 106.

According to various embodiments, the bracket 100 is structured to be coupled to both a cylinder block and a cylinder head of an internal combustion engine (e.g., as discussed below with respect to FIG. 6). The bracket 100 includes a set of third openings or holes 108 which are structured to interface with fasteners 109 (FIG. 2) to couple the bracket 100 to a mounting component such as a cylinder block. The third holes 108 may or may not be threaded.

The bracket 100 includes a flange 110. The flange 110 includes a set of fourth openings or holes 112 which are structured to interface with fasteners 111 (FIG. 2) to couple the bracket 100 to a component such as a cylinder block, a gear housing, or an accessory drive. The fourth holes 112 may or may not be threaded. The fourth holes 112 may be generally orthogonal to the third holes 108. In some implementations, one or more of the fourth holes 112 receive a spacer 113. The spacer 113 is configured to interface with the fastener 111 to prevent the fastener 111 from exerting undesirable forces on the flange 110.

The bracket 100 also includes a set of fifth openings or holes 114 which are structured to interface with fasteners 116 (e.g., cap screws) and threaded inserts 118 (e.g., set screws) to couple the bracket 100 to a mounting component such as a cylinder head, a gear housing, or an accessory drive. The fifth holes 114 are structured to be threaded and are structured to receive the threaded inserts 118 via a threaded interface (e.g., an M24 interface).

FIG. 3 is a cross-sectional view of the bracket 100 about plane A-A in FIG. 2. The bracket 100 includes an extension 300. The extension 300 causes the fifth holes 114 to be offset from the third holes 108. The bracket 100 also includes a collar 302 in each of the fifth holes 114. The collars 302 are configured to interface with a head on the fasteners 116. As shown in FIG. 3, the threaded inserts 118 are coupled to the fifth holes 114 and the fasteners 116 extend through the threaded inserts 118. In some implementations, the bracket 100 includes one or more access channels 304 facilitating access to corresponding fasteners 116. A head of a fastener 116 is accessible through a corresponding access channel 304. Each access channel 304 is aligned with one of the fifth holes 114. The access channel 304 facilitates rotation of the fastener 116 through the use of a tool (e.g., hex key, Allen wrench, driver, socket, etc.).

In some implementations, the bracket 100 includes one or more access channels 306 facilitating access to corresponding fasteners 109. A head of a fastener 109 is accessible through a corresponding access channel 306. Each access channel 306 is aligned with one of the third holes 108. The access channel 306 facilitates rotation of the fastener 109 through the use of a tool (e.g., hex key, Allen wrench, driver, socket, etc.).

FIG. 6 is a cross-sectional view of the bracket 100 about plane A-A as shown in FIG. 2, with the bracket 100 mounted to a first component, shown as cylinder head 600, and a second component, shown as cylinder block 602. While bracket 100 is shown in FIG. 6 and described as mounting to components of an internal combustion engine (e.g., cylinder head 600, cylinder block 602, etc.), it is understood that bracket 100 may similarly mount to other components (e.g., a gear housing, an accessory drive, etc.). The cylinder head 600 includes cylinder head openings or holes 604 and the cylinder block 602 includes cylinder block openings or holes 606. The cylinder head openings or holes 604 in the cylinder head 600 are aligned with the fifth holes 114 such that the fasteners 116 may threadably engage the cylinder head openings or holes 604. Similarly, the cylinder block openings or holes 606 in the cylinder block 602 are aligned with the third holes 108 such that the fasteners 109 may threadably engage the cylinder block openings or holes 606.

As shown in FIG. 6, the threaded insert 118 includes a body 608. The body 608 includes an inner surface 610 defining an aperture for receiving the fastener 116, an exterior surface 612 for threadably engaging with the fifth hole 114, and an end face 614 for interfacing with the cylinder block 602. In various implementations, the inner surface 610 is not threaded and the exterior surface 612 is threaded such that the threaded insert 118 may threadably engage the fifth hole 114. The aperture defined by the inner surface 610 is configured to couple with an implement (e.g., tool, driver, wrench, Allen wrench, hex key, etc.) for rotating the threaded insert 118 within the fifth hole 114. In various implementations, the inner surface 610 defines a hexagonal opening having a standard size and being configured to securely receive a hexagonal key. However, the inner surface 610 may alternatively define other shapes such as a Torx®, double-square, slot, cross, or other shape.

As seen in FIG. 6, a cross-sectional profile of the bracket 100 may not exactly match a cross-sectional profile of the cylinder head 600 and the cylinder block 602, and one or more gaps may exist between the bracket 100 and the cylinder head 600 and/or the bracket 100 the cylinder block 602. In some instances, such a gap may be about two millimeters or more (or less). Gaps may lead to increased stress and undesirable performance at various locations on the bracket 100 during assembly and operation. Bridging a gap with fasteners alone (e.g., each fastener 116 in a corresponding fifth hole 114 without a threaded insert 118) would assist in positioning and securing the bracket 100, but the bracket 100 may still move with respect to the cylinder head 600 (e.g., in a direction perpendicular to the cross-section shown in FIG. 6 (perpendicular to the page), etc.) and large stresses could be asserted on the fasteners by the movement. Use of the threaded insert 118 provides additional structure within the fifth hole 114 and is also adjustable to bridge a gap formed between the particular combination of the bracket 100, cylinder head 600, and cylinder block 602. Thus, the bracket 100 may be held more firmly in position by the combination of the threaded insert 118 and the fastener 116.

By rotating the threaded insert 118, the end face 614 may be selectively repositioned such that it is in contact with the cylinder head 600. In this way, the threaded insert 118 serves as an adjustable extension of the bracket 100. Due to the configuration of the fifth holes 114 and the threaded inserts 118, adjustment of the threaded inserts 118 can be performed by inserting an adjustment tool through the fifth holes 114 and the access channel 304 and causing a rotation of the threaded inserts 118 using the adjustment tool.

In various implementations, the fasteners 116 are partially threaded. In some implementations, the fasteners 116 are cap screws with an unthreaded portion having a first diameter and a threaded portion having a second diameter smaller than the first diameter. When the fastener 116 is inserted through the threaded insert 118 and into the cylinder block 602, the inner surface 610 of the threaded insert 118 may contact the unthreaded portion of the fastener 116.

An additional gap may exist between the flange 110 and the cylinder block 602. This gap may also cause undesirable stresses in the bracket 100. The spacers 113 (FIG. 2) may be used to bridge gaps between the flange 110 and the cylinder block 602, allowing for improved positioning and securing of the bracket 100 to the cylinder block 602 by the fasteners 111 in combination with the spacers 113.

FIG. 7 illustrates a first alternator 700 and a second alternator 702 coupled to the bracket 100. The first alternator 700 is positioned above the second alternator 702.

Figure 8:
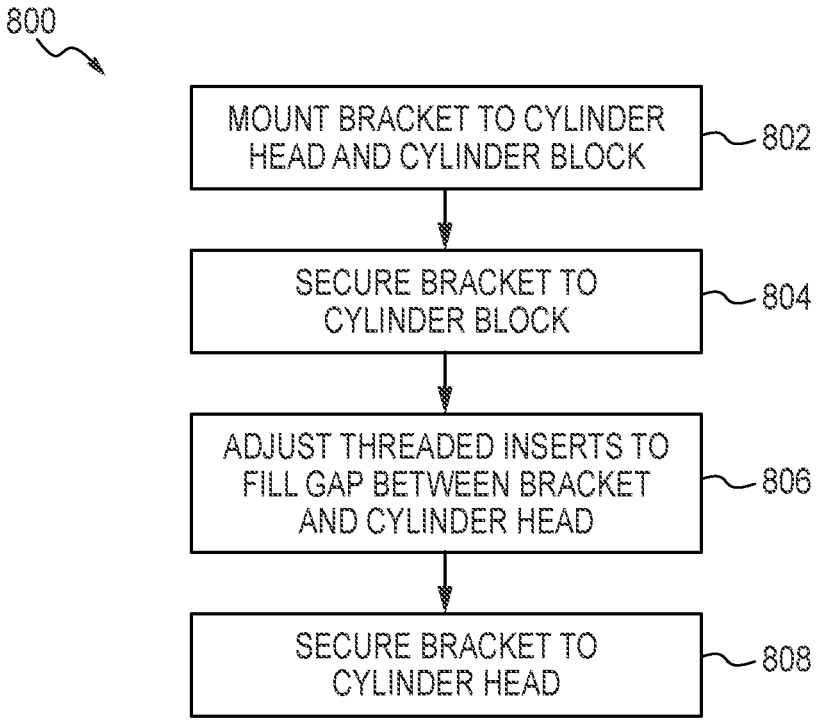
FIG. 8 is a block diagram of a method for attaching a bracket to a cylinder head and a cylinder block according to an embodiment.

FIG. 8 illustrates a method 800 for installing the bracket 100 on the cylinder head 600 and the cylinder block 602. First, at 802, an operator (e.g., installer, worker, mechanic, etc.) mounts the bracket 100 to the cylinder head 600 and the cylinder block 602. Here, the operator may, for example, hold the bracket 100 such that it is properly aligned with, and sufficiently close to, the cylinder head 600 and the cylinder block 602. Next, at 804, the operator secures the bracket 100 to the cylinder block 602 through the use of fasteners 109 and fasteners 111. Next, at 806, the operator adjusts the threaded inserts 118 to selectively fill a gap between the bracket 100 and the cylinder head 600. For example, the operator may insert a hex key through one of the fifth holes 114 into the inner surface 610 which defines a hexagonal opening. The operator may then rotate the hex key to correspondingly rotate the threaded insert 118. Once the end face 614 is in contact with the cylinder head 600, the operator may remove the hex key. Next, at 808, the operator secures the bracket 100 to the cylinder head 600 through the use of the fasteners 116. The fasteners 116 threadably engage the fifth holes 114 and the cylinder head openings or holes 604 in the cylinder head 600. As the fasteners 116 are tightened, the cylinder head 600 is tightened against the end faces 614 of the threaded inserts 118.

Figure 9:
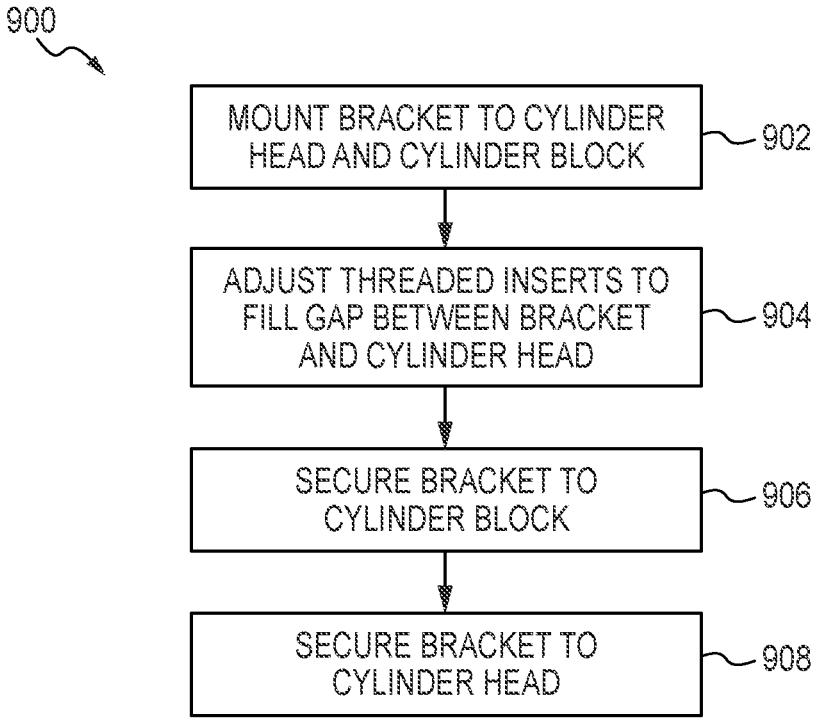
FIG. 9 is a block diagram of a method for attaching a bracket to a cylinder head and a cylinder block according to an embodiment.

FIG. 9 illustrates another method 900 for installing the bracket 100 on the cylinder head 600 and the cylinder block 602. First, at 902, an operator (e.g., installer, worker, mechanic, etc.) mounts the bracket 100 to the cylinder head 600 and the cylinder block 602. Here, the operator may, for example, hold the bracket 100 such that it is properly aligned with, and sufficiently close to, the cylinder head 600 and the cylinder block 602. Next, at 904 the operator adjusts the threaded inserts 118 to selectively fill a gap between the bracket 100 and the cylinder head 600. For example, the operator may insert a hex key through one of the fifth holes 114 into the inner surface 610 which defines a hexagonal opening. The operator may then rotate the hex key to correspondingly rotate the threaded insert 118. Once the end face 614 is in contact with the cylinder head 600, the operator may remove the hex key. Next, at 906, the operator secures the bracket 100 to the cylinder block 602 through the use of fasteners 109 and fasteners 111. Next, at 908 the operator secures the bracket 100 to the cylinder head 600 through the use of the fasteners 116. The fasteners 116 threadably engage the fifth holes 114 and the cylinder head openings or holes 604 in the cylinder head 600. As the fasteners 116 are tightened, the cylinder head 600 is tightened against the end faces 614 of the threaded inserts 118. In some implementations, 906 and 908 may be switched depending on the target application.

Figure 10:
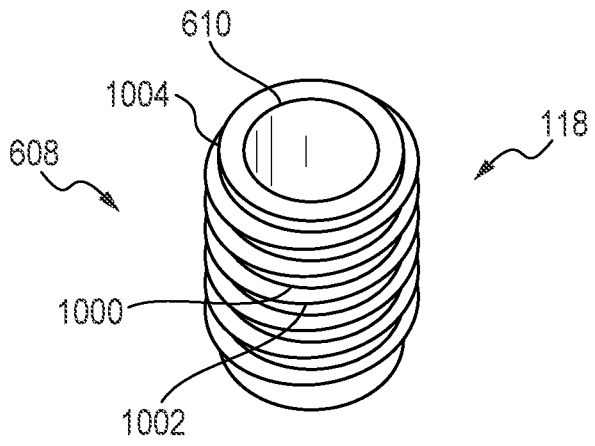
FIG. 10 is a top perspective view of a threaded insert according to an embodiment.
Figure 11:
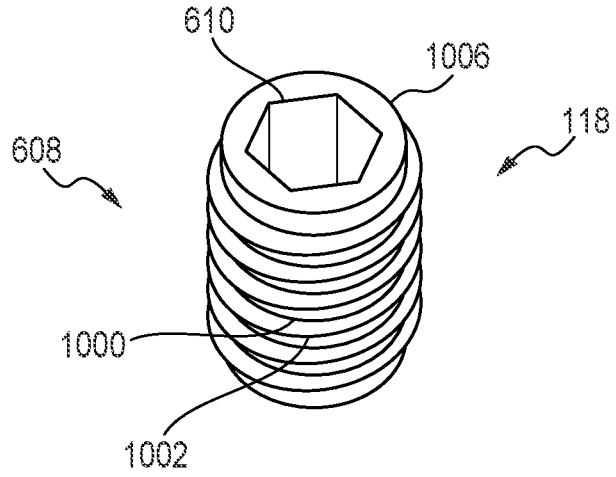
FIG. 11 is a bottom perspective view of the threaded insert of FIG. 10.

FIGS. 10 and 11 illustrate various views of the threaded insert 118 according to an embodiment. The threaded insert 118 is generally cylindrical and includes the body 608, the inner surface 610, the exterior surface 612, and the end face 614 as previously described.

While the present disclosure contains specific implementation details, these should not be construed as limitations on the scope of what may be claimed, but rather as descriptions of features specific to particular implementations. Certain features described in this specification in the context of separate implementations can also be implemented in combination in a single implementation. Conversely, various features described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

It should be noted that references to "front," "rear," "upper," "top," "bottom," "base," "lower," and the like in this description are used to identify the various components as they are oriented in the figures. These terms are not meant to limit the component which they describe, as the various components may be oriented differently in different embodiments.

Further, for purposes of this disclosure, the term "coupled" means the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

It is important to note that the construction and arrangement of the system shown in the various example implementations are illustrative and not restrictive in character. All changes and modifications that come within the spirit and/or scope of the described implementations are desired to be protected. It should be understood that some features may not be necessary and implementations lacking the various features may be contemplated as within the scope of the application, the scope being defined by the claims that follow. When the language "at least a portion" and/or "a portion" is used the item can include a portion and/or the entire item unless specifically stated to the contrary.

What is claimed is:

1. A bracket, comprising:

a bracket body defining a first opening positioned to align with a second opening in a cylinder head, the bracket body comprising a first flange located in the first opening, the first flange defining a first aperture;

a threaded insert received in the first opening between the cylinder head and the first flange, the threaded insert comprising:

an exterior surface threadably engaged with the first opening;

an inner surface defining a second aperture; and an end face;

wherein rotation of the threaded insert in the first opening facilitates selective repositioning of the threaded insert in the first opening; and a fastener configured to be received in the first aperture and the second aperture, the fastener configured to threadably engage with the second opening, the fastener comprising a second flange configured to interface with the first flange when the fastener is threaded into the second opening;

wherein the second aperture is configured to receive a tool for selective rotation of the threaded insert.

2. The bracket of claim 1, wherein the bracket is attached to a second component separate from the cylinder head; and wherein the bracket is supported by the second component through the attachment to the second component.

3. The bracket of claim 1, the bracket body further defining an access channel aligned with the first opening and configured to allow passage of the tool to the threaded insert.

4. The bracket of claim 1, wherein the bracket body comprises an extension that protrudes from the bracket body; and wherein the first opening is located in the extension.

5. The bracket of claim 1, wherein the second aperture of the threaded insert defines a hexagonal portion configured to receive the tool.

6. A system for supporting an alternator on a cylinder head and a cylinder block, the system comprising:

a bracket configured to receive and support at least one alternator, the bracket comprising an extension defining a first opening, a threaded insert in the first opening, and a fastener in the threaded insert, the threaded insert including an exterior surface threadably engaged with the first opening and an inner surface defining an aperture, the fastener positioned in the aperture;

wherein the first opening in the bracket is defined to align with a second opening in the cylinder head;

wherein the aperture defines a tool interface, and rotation of the threaded insert by force exerted in the tool interface causes rotation of the threaded insert in the first opening such that an end face of the threaded insert selectively moves relative to the cylinder head; and wherein the bracket is further configured for attachment to the cylinder block.

7. The system of claim 6, wherein the bracket further comprises a first flange located in the first opening; and wherein the threaded insert is configured to be located in the first opening between the cylinder head and the first flange.

8. The system of claim 7, wherein the fastener comprises a second flange configured to interface with the first flange to facilitate attachment of the bracket to the cylinder head.

9. The system of claim 6, wherein the bracket further comprises an access channel aligned with the first opening and configured to allow passage of a tool to the threaded insert.

10. A system comprising:

a cylinder block;

a cylinder head coupled to the cylinder block, the cylinder head defining a first opening;

a bracket comprising an extension, the extension defining a second opening, the second opening aligned with the first opening; and a first threaded insert received in the second opening, the first threaded insert defining a first aperture, the first aperture receiving a first fastener that extends from the second opening and is threadably engaged with the first opening;

wherein the first aperture selectively receives a tool; and wherein rotation of the tool in the first aperture causes rotation of the first threaded insert in the second opening such that a first end face of the first threaded insert is selectively repositioned relative to the cylinder head.

11. The system of claim 10, wherein the bracket further comprises a first flange located in the second opening; and wherein the first threaded insert is positioned between the cylinder head and the first flange.

12. The system of claim 11, wherein the first fastener comprises a second flange interfacing with the first flange to facilitate attachment of the bracket to the cylinder head.

13. The system of claim 10, wherein the bracket further comprises an access channel aligned with the second opening, the access channel facilitating passage of the tool to the first threaded insert.

14. The system of claim 10, further comprising a second threaded insert defining a second aperture, the second aperture receiving a second fastener;

wherein the cylinder head defines a third opening;

wherein the extension defines a fourth opening aligned with the third opening;

wherein the second threaded insert is received in the fourth opening; and wherein the second fastener extends from the fourth opening and is threadably engaged with the third opening.

15. The system of claim 14, wherein the second aperture selectively receives the tool; and wherein rotation of the tool in the second aperture causes rotation of the second threaded insert in the fourth opening such that a second end face of the second threaded insert is selectively repositioned relative to the cylinder head independent of rotation of the first threaded insert.

16. A system for providing support from a first component and a second component, the system comprising:

a bracket comprising an extension defining a first opening, a threaded insert in the first opening, and a fastener in the threaded insert, the threaded insert including an exterior surface threadably engaged with the first opening and an inner surface defining an aperture, the fastener positioned in the aperture;

wherein the first opening in the bracket is defined to align with a second opening in the first component;

wherein the fastener threadably engages with the second opening;

wherein the aperture defines a tool interface, and rotation of the threaded insert by force exerted in the tool interface causes rotation of the threaded insert in the first opening such that an end face of the threaded insert selectively moves relative to the first component; and wherein the bracket is further configured for attachment to the second component such that the bracket is fixed to, and supported by, the second component.

17. The system of claim 16, wherein the extension comprises a first flange located around the first opening;

wherein the fastener comprises a second flange; and wherein the second flange interfaces with the first flange.

18. The system of claim 16, wherein the bracket further comprises an access channel aligned with the first opening, the access channel facilitating passage of a tool to the threaded insert.

19. A bracket, comprising:

a bracket body defining a first opening positioned to align with a second opening in a cylinder head, the first opening configured to threadably engage with a fastener, the bracket body comprising a first flange located in the first opening, the first flange defining a first aperture configured to receive the fastener and configured to interface with a flange of the fastener when the fastener is threaded into the second opening; and a threaded insert configured to be received in the first opening between the cylinder head and the first flange when the bracket is installed, the threaded insert comprising:

an exterior surface threadably engaged with the first opening;

an inner surface defining a second aperture configured to receive the fastener; and an end face;

wherein rotation of the threaded insert in the first opening facilitates selective repositioning of the threaded insert in the first opening; and wherein the second aperture is configured to receive a tool for selective rotation of the threaded insert.

20. The bracket of claim 19, wherein the bracket body further defines an access channel aligned with the first opening and configured to allow passage of the tool to the threaded insert.

* * * * *